US006067766A

United States Patent [19]

Badke

[11] Patent Number: 6,067,766

[45] Date of Patent: May 30, 2000

[54] STRAIGHT-SAWN SHAKE AND METHOD AND APPARATUS FOR THE FABRICATION OF SAME

[75] Inventor: Larry Badke, Mission, Canada

[73] Assignee: Intertek Testing Services NA Ltd., Coquitlam, Canada

[21] Appl. No.: 08/922,401

[22] Filed: Sep. 3, 1997

[51] Int. Cl.[7] ..... E04D 1/00

[52] U.S. Cl. ..... 52/518; 52/554

[58] Field of Search ..... 52/518, 516, 517, 52/554, 416; 428/106

[56] References Cited

U.S. PATENT DOCUMENTS

| | | | |
|---|---|---|---|
| 4,015,392 | 4/1977 | Eaton | 52/533 |
| 4,731,145 | 3/1988 | Senzani | 156/264 |
| 5,135,597 | 8/1992 | Barker | 156/264 |
| 5,248,541 | 9/1993 | Tilby | 428/106 |
| 5,570,553 | 11/1996 | Balkins | 52/518 |

*Primary Examiner*—Beth A. Aubrey
*Attorney, Agent, or Firm*—Carter & Schnedler, P.A.

[57] ABSTRACT

A straight-sawn shake (10) for roof and wall cladding is described. The shake (10) is comprised of a flat wooden board piece (11) of substantially predetermined thickness throughout. The wooden board piece (11) has opposed flat, substantially parallel, sawn surfaces (12,12') and parallel straight side sawn edges (13,13') and at least a straight sawn transverse rear end edge (14). The front end edge (14') may be a straight end edge or may have a decorative design. The board piece (11) is cut from a raw log piece (32) of predetermined length in block form (31). The method of fabricating the straight-sawn shake (10) and the apparatus (25) is also described.

13 Claims, 4 Drawing Sheets

STRAIGHT-SAWN SHAKE AND METHOD AND APPARATUS FOR THE FABRICATION OF SAME

TECHNICAL FIELD

The present invention relates to a straight-sawn shake which is of predetermined thickness throughout and which has opposed flat sawn surfaces, and to its method and apparatus for its fabrication.

BACKGROUND ART

Various types of wooden shakes and shingles are known and these are usually produced from a log block by splitting or sawing tapered board pieces from the block. Other shakes are produced by end splitting a board piece of substantially uniform thickness from the log block and then sawing the board piece at an angle whereby to produce tapered shakes, which in this case, have an uneven surface created by the grain of the wood when it is split and the other surface is a flat sawn surface. Other shakes are produced wherein both sides of the shake have an uneven surface by splitting the block, end-for-end, at an angle. This process is largely a manual process. Other shakes (tapersawn shakes) are produced by sawing tapered pieces from a log block thereby creating a tapered shake with both sides flatsawn. In fact, the manufacturing of shakes is greatly a manual process and includes manual classification of several different types and grades.

Split shakes are distinguished from shingles in that they are of substantially constant thickness, with at least one split surface ⅜" to ¾" thick, and cut in lengths of 18 inches or 24 inches. The best shakes are usually produced from clear heartwood log blocks which can produce 100 percent edgegrain with no defects. The shake is split from a log block with the split oriented at an angle of approximately 45 degrees or more to annual rings so that the surface of the shake has an edge or vertical grain which creates an elongated ripple effect throughout and extending longitudinally of the shake. This ripple effect surface is pleasing to the eye when a roof or wall is cladded with the shakes. Some other types of shakes permit the inclusion of flatgrain which is caused when the rings form an angle of less than 45 degrees with the surface of the shake. Flatgrain was proven to be less durable than edgegrain when exposed to the weather. Furthermore, when a roof or wall is constructed with shakes, the exposed surface of each course of shakes can be made greater than with shingles. When splitting a log block to form a shake, the cut shake will follow some grain divergence and generally will not be of a uniform constant plane thereacross and may have some curvature therein. Split shakes are graded on their best split face. Tapersawn shakes and shingles are graded from the best face. Premium grade shakes are usually free of manufacturing defects such as shims and feather tips and should be 100 percent clear heartwood and 100 percent edgegrain.

When shakes are split from log blocks, often these may have a curvature therein due to the direction of the grain. In order to produce good quality premium and No. 1 grade split shakes, it is very important to select top grade logs and this demand has escalated the cost of these logs. Only log blocks with very fine wood grain can split straight and because of the shrinking raw material supply it has become more difficult to get the type and quality of raw material that will split properly The classification and grading of shingles by wood grain and other natural or machine defects is a difficult one as the operator must quickly, within a split second, identify the type of grain of the product produced, be it cross grain, diagonal grain, edge vertical grain, flat grain, or mixed grain. Accordingly, with so many classifications, it can be appreciated that it is extremely difficult to obtain accurate classification and often, to eliminate errors the classification may be repeated in the production line.

It can therefore be appreciated that shingles and split shakes are costly materials due to the fact that they are labour intensive to produce and utilize high quality selected logs that are capable of being split substantially uniformly from log pieces that are cut in block form. It can be appreciated that these methods of fabrication result in substantial material waste. Also, old growth fine grained logs are becoming more and more difficult to find and its cost escalation is also the result of over exploitation. There is therefore a need to produce a shake from poorer grade logs which are not heartwood and which may have imperfections and knots which restrict the manufacture of split shake products. A method of manufacture which is less labour intensive and less costly would be desirable.

SUMMARY OF INVENTION

It is therefore a feature of the present invention to provide a straight-sawn shake of substantially predetermined thickness throughout and having opposed flat sawn surfaces.

Another feature of the present invention is to provide a straight-sawn shake having opposed flat sawn surfaces which may include flat grain, knots and other deficiencies and which is of substantially constant thickness throughout.

Another feature of the present invention is to provide straight-sawn shakes manufactured from poorer grade logs and properly utilize a much greater portion of the log than heretofore achieved with prior art methods of manufacture.

Another feature of the present invention is to provide a method of fabricating straight-sawn shakes of substantially uniform predetermined thickness throughout and wherein the shake has opposed flat sawn surfaces and further wherein at least portions of some of said surfaces may include deficiencies therein.

Another feature of the present invention is to provide a straight-sawn shake fabricating system wherein shakes of substantially predetermined thickness are sawn from log blocks and wherein at least part of the surfaces of the shakes may have deficiencies therein.

Another feature of the present invention is to provide a straight-sawn shake and a method and apparatus for the fabrication thereof and wherein the shake may have three or more grades.

Another feature of the present invention is to provide a straight-sawn shake which is easier to fabricate than the prior art shakes and which is of reduced cost.

Other features are achieved with the manufacture of the straight-sawn shake of the present invention in that it contributes to other benefits, such as waste management and conservation as the shakes can be manufactured from poorer grade logs as compared to most other types of shakes. Further, since shakes are applied at significantly increased weather exposures than shingles, the manufacturer is able to maximize the yields per cubic meter of raw material used. In addition, by being able to cut a poorer shingle grade log which includes knots and various other deficiencies, the problem associated with inexperienced shingle sawyers unable to properly use the "grainer" attachment on the shingle machine, is virtually eliminated. The end result is much less wood waste.

According to the above features, from a broad aspect, the present invention provides a straight-sawn shake for roof and wall cladding of building structures and wherein the shake is comprised of a flat wooden board piece of substantially predetermined thickness throughout. The wooden board piece has opposed, parallel, flat sawn surfaces and substantially parallel straight side sawn edges and substantially straight sawn rear end edges. The board piece is cut from a raw log piece of predetermined length in block form.

According to a further broad aspect of the present invention there is provided a method of fabricating straight-sawn shakes of substantially uniform predetermined thickness throughout and having opposed flat, substantially parallel sawn surfaces. The method comprises cutting log blocks of predetermined lengths from a wooden log to produce log blocks having opposed substantially flat parallel ends. One of the log blocks is placed in the saw carriage and is secured by the opposed parallel ends with a support mechanism having adjustable increment advancing means to displace the log block a predetermined distance after a board piece of predetermined, substantially uniform thickness, has been cut by a saw blade from across the log block transverse to the parallel ends. The board piece has opposed parallel straight end edges. The opposed side edge of the board piece is then trimmed by cutting transverse to the end edges to produce a straight-sawn shake of substantially uniform thickness throughout.

According to a further broad aspect of the present invention there is provided a straight-sawn shake fabricating system which comprises conveyor means for conveying a wooden log to a log cutting machine (cutoff saw) to form log blocks having opposed flat, substantially parallel ends. Large log blocks are then divided into manageable pieces normally by use of a hydraulic splitting axe which penetrates the top transverse end of the log block. A log block support mechanism is provided on the shake machine and has displaceable log block engaging means for securing a log block from the opposed flat parallel ends and at a predetermined orientation. The support mechanism has adjustable increment advancing means to displace the log block laterally a predetermined distance. Means is provided to cut a board piece of predetermined thickness from the log block. The increment advancing means displaces the log block a predetermined distance equal to the predetermined thickness each time a board piece is cut from the log block. A trimming device, called a jointer saw, is used to cut-off the side edges of the board piece to form a straight-sawn shake of substantially rectangular outline and having a uniform thickness to define substantially parallel opposed flat sawn surfaces.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
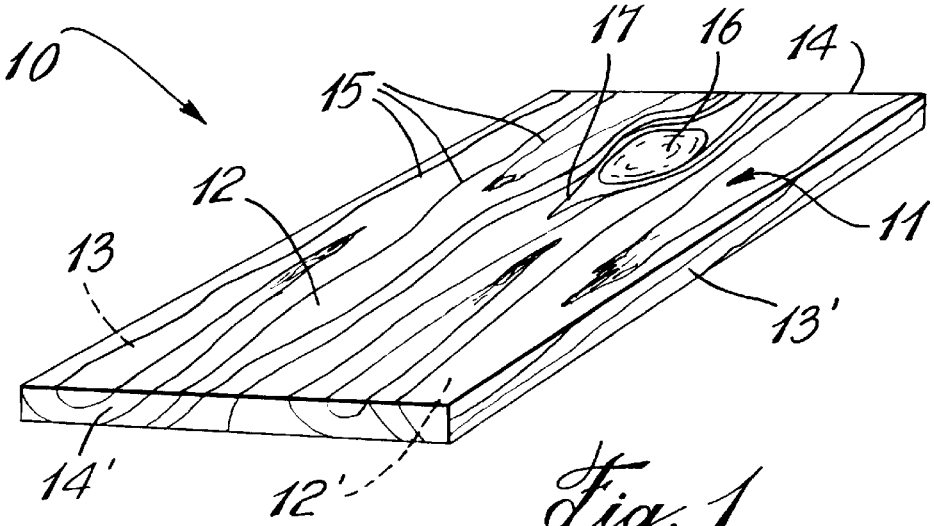
FIG. 1 is a perspective view of a straight-sawn shake fabricated in accordance with the present invention.

Straight-sawn shakes, such as shown in FIG. 1 and generally denoted by reference numeral 10 have not heretofore been provided. An advantage of such straight sawn shake 10 is that it can be fabricated from lower grade logs and substantially all of the log can be used for its fabrication. With current methods of fabrication the logs need to be of high grade quality in order to split shakes therefrom. Accordingly, with the present invention, substantial material waste can be avoided while producing less costly shakes. This also results in the fabrication of shakes having more grades than heretofore possible when using heartwood for the fabrication of same. Furthermore, the shakes produced by the present invention are also less labour intensive to produce.

As can be seen from FIG. 1, the straight-sawn shake 10 is of substantially rectangular outline and is comprised of a flat thin wooden board piece 11 of substantially predetermined thickness throughout. This is achieved by sawing the shake from a log block to produce a board piece 11 which has opposed flat sawn surfaces 12 and 12'. The board piece is trimmed to have substantially parallel straight side sawn edges 13 and 13'. As hereinshown the rear and front end edges 14 and 14' are sawn edges, although the front end edge 14' may also be sawn with an ornamental pattern such as a semi-circular shape for decorative purposes and particularly for use in the construction of wall cladding.

As hereinshown the woodgrain 15 extends substantially longitudinally from the front end edge 14' to the rear end edge 14. The straight-sawn shake 10 may also include imperfections in the woodgrain such as knots 16 as shown herein or a grain deficiency such as shown at 17. However, it can be noted that the straight-sawn shake, shown in FIG. 1, has a substantial front portion of the top surface 12 which has a clear wood grain and this is the surface that would normally be exposed in the fabrication of roof and wall cladding. Accordingly, it could be classified as a quality product when oriented properly by an installer or carpenter. It can therefore be appreciated that with the straight-sawn shake of the present invention, use can be made of sections of a log piece which is not perfect, that is to say which does not have a constant edgegrain throughout at least one of its opposed surfaces 12 or 12'. Preferably, the shake is of uniform thickness of approximately ⅜".

Figure 2:
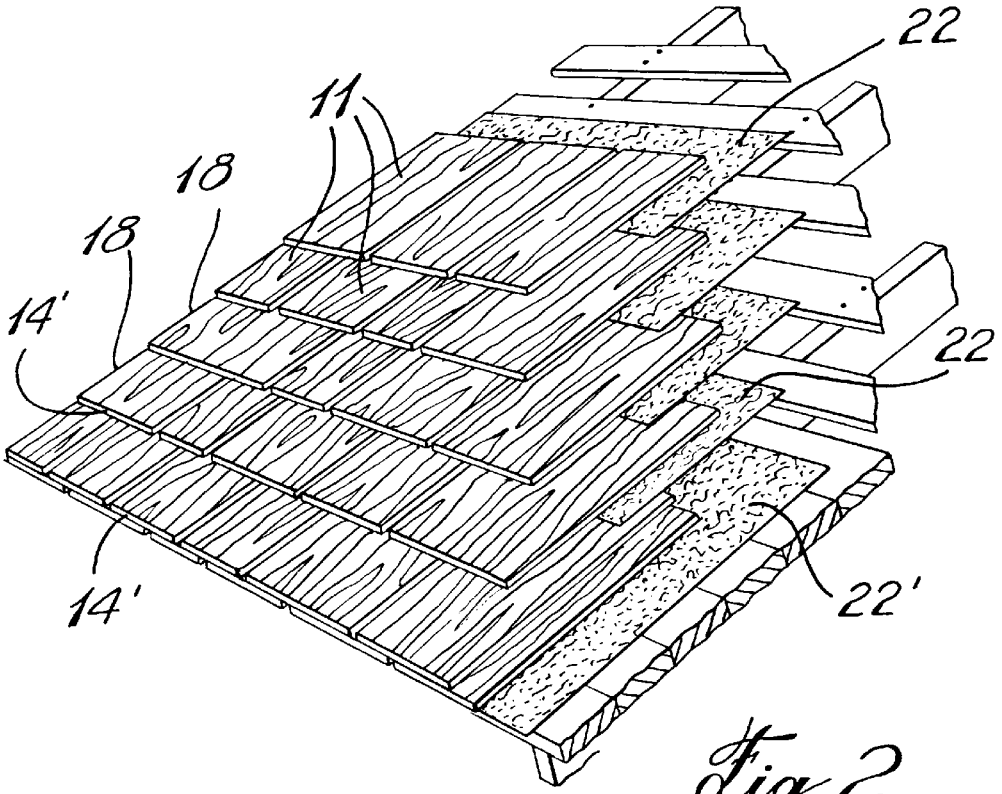
FIG. 2 is a perspective view showing a roof being cladded with straight-sawn shakes of the present invention.
Figure 3:
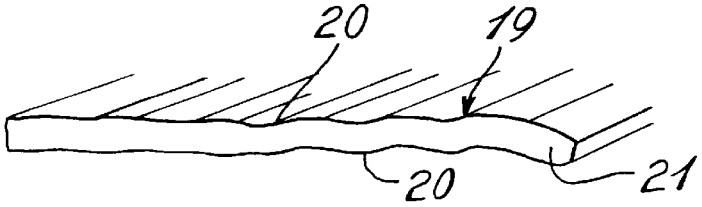
Fig. 3 (PRIOR ART)
FIG. 3 is an end section view showing a shake fabricated in accordance with the prior art and having opposed split surfaces.

As shown in FIG. 2, when a roof is cladded with the shakes 10 it comprises a plurality of wooden board pieces 11 secured in straight courses 18 disposed substantially parallel to one another and with adjacent courses overlapping in flat face-to-face relationship with substantially no undulations along exposed end edges 14' of the entire courses. It can therefore be appreciated that with the straight-sawn shake of the present invention there are no undulations along the end edges caused by woodgrain when split. With the split shakes of the prior art, as shown at 19 in FIG. 3, undulations 20 are formed on opposed side faces of the shakes due to the fact that when splitting the shake the split will follow the woodgrain and this usually results in undulations or corrugation. Also, the grain can produce larger undulation or a curvature in the shake such as illustrated at 21. It could therefore be appreciated that when a roof is being cladded with such shakes that the end edges will be uneven and although providing an appearance of ruggedness which is often sought in architectural design, it can also produce other problems such as cracking and splitting due to foot traffic while installing the product which can result in roof leakage. It also results in added waste if the shake is discarded by the installer. As previously described the advantage of shakes over shingles is that the weather exposure portion of the shake is greater than shingles by about 15 percent.

The straight-sawn shakes of the present invention may have a length of 16, 18 or 24 inches. When installed on roofs 16 inch straight-sawn shakes are applied from 5 to 7 inches to the weather and this will depend on the grade of the shake. If the length is 18 inches the weather exposure of each course is from about 5 ½ to 7½ inches and this will depend on the grade of the shake. The weather exposure area is the distance between opposed front end edges 14' of each course, as shown in FIG. 2. With 24 inch shakes the weather exposure is from about 7½ to 10 inches, again depending on the grade of the shake. Preferably, these shakes are produced from log pieces cut from cedar, fir, pine, spruce or similar type trees wherein the wood has improved weathering qualities. The shakes may also be treated with a preservative to increase the weathering longevity thereof. As also shown in FIG. 2, felt sheets 22 are laid over the top upper portion of each of the courses of shakes and in such a manner whereby the surface coverage has an intermediate felt surface thereover and entirely under the overlapping courses of the wooden board pieces. A lower felt sheet. 22' provides wave protection. This is the conventional method of fabricating shake cladded roofs. The rectangular shakes 10 are also spaced from one another with each shake overlapping these spaces from adjacent courses. Installing shakes of the present invention which have opposed substantially parallel flat sawn faces is much easier and therefore less costly as compared to shakes having at least one split surface.

Figure 4:
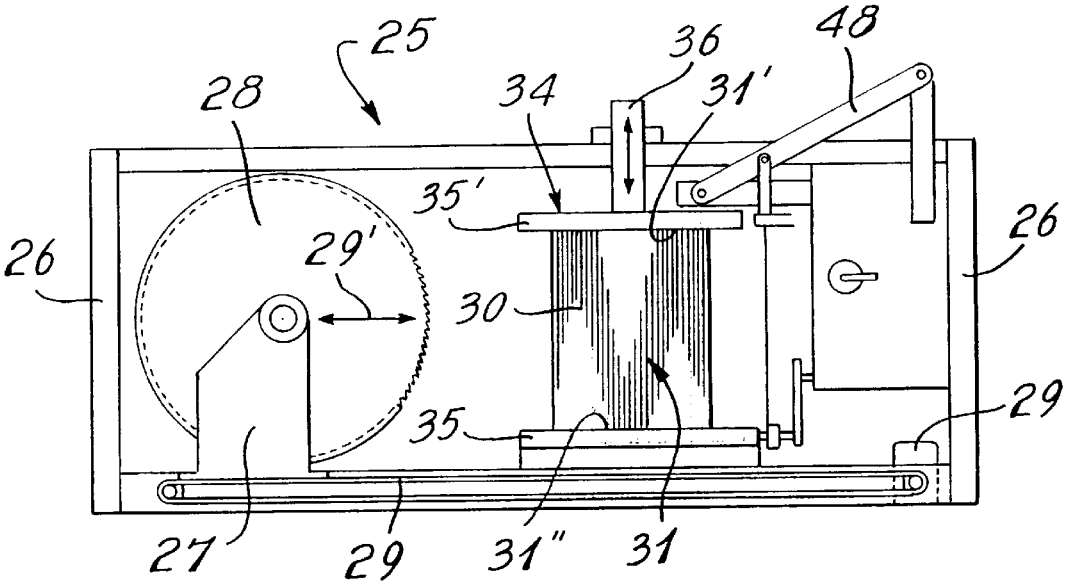
FIG. 4 is a simplified schematic view showing the construction of the log block cutting machine to produce wooden board pieces of substantially predetermined thickness throughout.

Referring now to FIG. 4 there is shown part of the machinery of the straight-sawn shake fabricating system. The log block cutting machine 25 as hereinshown is comprised of a frame 26 in which a carriage 27 is supported by a track and wheels. A circular saw blade 28 is mounted on a shaft and a separate frame is suspended within the front portion of the saw carriage frame. The carriage 27 is secured to a drive train 29 to displace the saw blade 28 in opposed directions as illustrated by arrow 29' wherein to cut a slice or a board piece 11' (see FIG. 6A) from a front face 30 of a log block 31.

Figure 5:
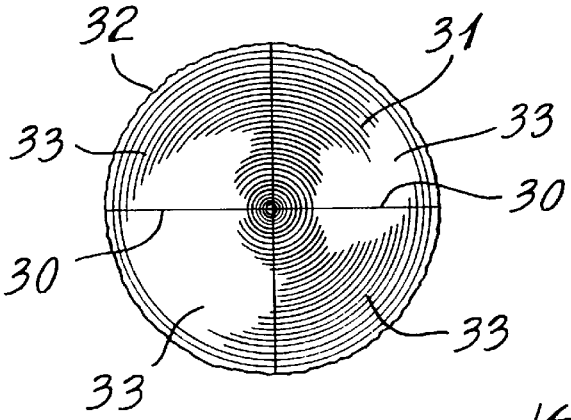
FIG. 5 is a top section view showing a log block and the manner in which it is cut in wedge pieces to produce shakes having a vertical or edge grain extending longitudinally along the shake with less grain imperfections.

Referring to FIG. 5, there is shown the manner in which the log blocks 31 are produced. As hereinshown a log block of predetermined length has been cut from a log 32 and the log piece is then split in pie-shape sections 33 to form the log blocks 31. These blocks 31 are split substantially transverse to the annual rings 33 to produce flat faces 30 having a vertical or edgegrain, wherever possible as shown at 15 in FIG. 1.

Figure 6A:
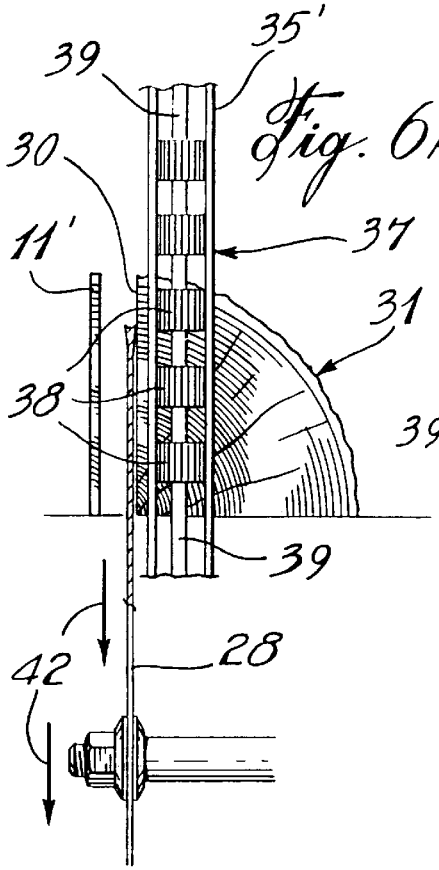
FIG. 6A is a top view of the increment advancing mechanism which moves the log block a predetermined distance and showing a board piece of substantially uniform thickness having been cut from a face of a log block.
Figure 6B:
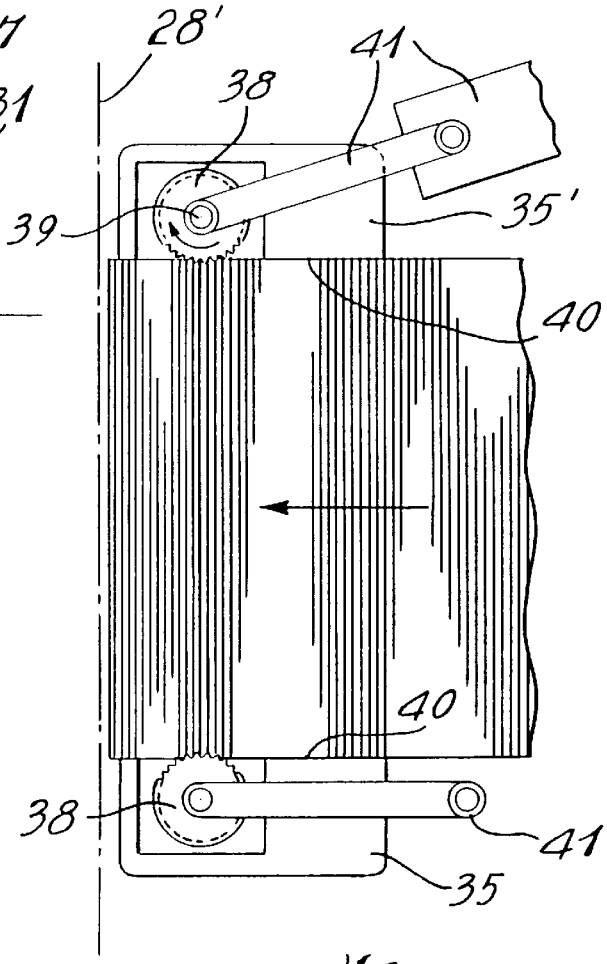
FIG. 6B is a side view showing the increment advancing mechanism an its engagement with the log block.
Figure 6C:
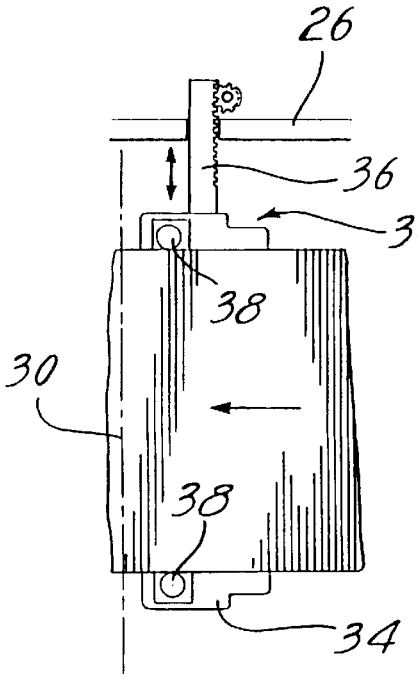
FIG. 6C is a schematic side view showing the log block secured between the increment advancing device and further illustrating the adjustment mechanism for accepting log blocks of different lengths.

A log block support mechanism 34 is provided with a pair of vertically aligned support frames 35 between which the log block 31 is supported from opposed flat ends 31' and 31". The upper support frame 35' is secured to an adjustable frame member 36 whereby to receive log blocks 31 having different lengths to produce shakes of different lengths. The support frames 35 and 35' are also provided with increment advancing means as better illustrated in FIGS. 6A to 6C and denoted generally by reference numeral 37. The increment advancing means is comprised of two shafts containing a plurality of block engaging wheels 38 each having a block engaging surface about its circumference for gripping the opposed flat parallel ends 31' and 31" of the log block 31. The wheels are part of a solid drive shaft 39. The log engaging surface of the wheels projects above a support surface 40 of the support frames 35 and 35', as better seen in FIG. 6B, to engage with the opposed flat ends of the log block whereby to advance the log block, as necessary. The wheels 38 are secured to a drive coupling mechanism 41, respectively, whereby the log is advanced uniformly and in a plane parallel to the saw-blade axis 28', as shown in FIG. 6B, whereby slices or board pieces 11 of substantially uniform thickness are cut from the front face 30 of the log block each time the saw blade 28 is advanced across the log block, as shown in FIG. 6A. FIG. 6A shows the saw blade in its retracting cycle as indicated by arrow 42. Once the saw blade 28 clears the front face of the log block, the increment advancing mechanism 37 is actuated to advance the log block a predetermined distance. This predetermined distance is also adjustable by controls whereby to cut board pieces of predetermined thickness depending on the thickness of the shake desired. The linkage mechanism 41 is an adjustable ratchet device which is secured to a respective one of the drive shafts 39 on which the wheels 38 are contained. The ratchet devices are actuated by a linkage 48 which is actuated by the return cycle of the reciprocal saw blade carriage 27 whereby to advance the log block the predetermined increment or distance.

Figure 7:
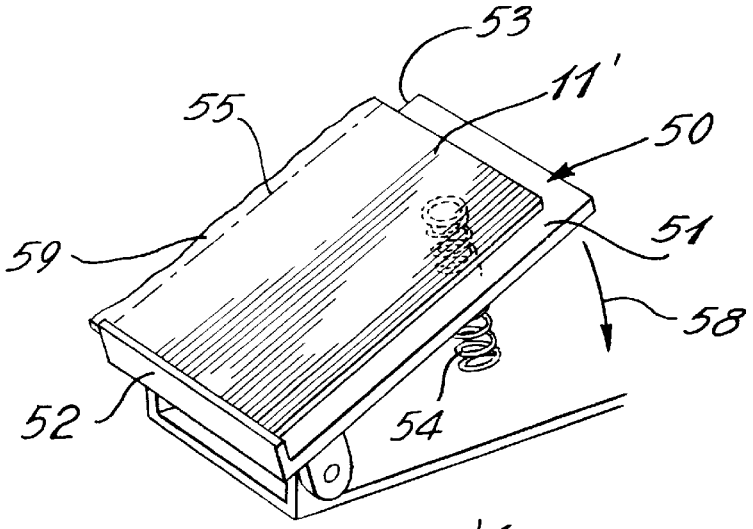
FIG. 7 is a perspective view showing in schematic form, the construction of the trimming device.

Referring now to FIG. 7, there is shown a trimming device comprised of a pivotal support platform 50 which has a flat support surface 51 and a straight transverse abutting end wall 52 adjacent an end of the support surface and projecting thereabove. The support platform 50 has a straight outer edge 53 extending transverse to the abutting end wall 50. The support platform is spring-biased by a biasing means, herein schematically illustrated at 54, relative to a trimming cutting blade, herein not shown but disposed along the axis 55. Most means are not equipped with lazer lights to cut irregular end edges of the board piece 11 or other undesirable section of the board piece 11' to produce a straight-sawn shake of rectangular outline. Accordingly, the operator places the board piece 11' on the support surface 51 of the platform 50. The platform 50 is then depressed in the direction of arrow 58 against its spring bias and across a saw blade whereby to cut off the imperfect side end piece 59 of the board piece 11' to form a straight sawn shake.

After the straight-sawn shake of substantially rectangular configuration is produced by the trimming operation, the operator then visually inspects the shake and places it in a specific bin or chute depending on his visual classification of the quality of the shake produced. As previously described, because these shakes may be produced from entire logs having imperfections therein, the shakes may have different colourations, different wood grain patterns and other imperfections therein such as knots or even knot holes and all of these must be classified to various types of uses.

Figure 8:
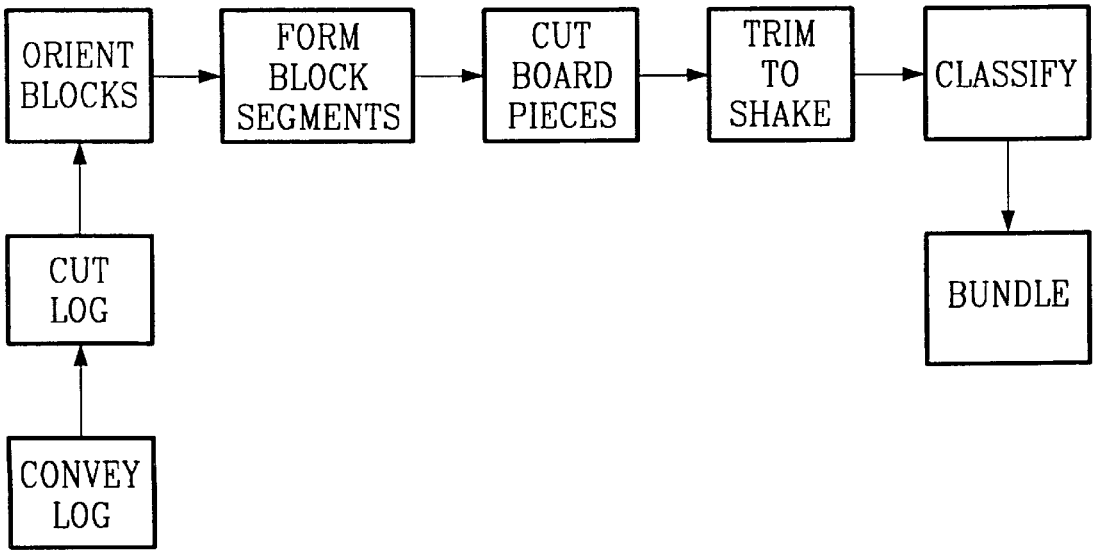
FIG. 8 is a block diagram illustrating the basic steps in the method of fabrication.

With additional reference now to FIG. 8, the method of operation of the apparatus or system as shown in FIGS. 4 to 7 will now be described. In the method of fabricating the straight-sawn shake of the present invention, logs of predetermined types such as cedar, fir, pine, spruce etc. are conveyed by conveying means, not shown, to a log cutting machine which may consist of a large chainsaw or circular saw and wherein log blocks, such as that shown at 31, of predetermined length are produced. The blocks are then oriented right side up and are split in pie shape segments 33 such as shown in FIG. 5. These log block segments are then loaded into the log block cutting machine 25 as shown in FIG. 4 with their substantially flat face 31 aligned with the axis of the circular saw blade 28 in such a manner to maximize the quantity of edgegrains shakes from the lock block. The saw blade is reciprocated across the log block and each time the blade is reciprocated, the log block is advanced by an increment advancing mechanism 34 whereby slices or board pieces 11 of predetermined thickness are cut from the log front face, as shown in FIG. 6A. These board pieces are then trimmed, with the apparatus as shown in FIG. 7, and the shakes thus produced are classified by the operator. These classified shakes are then bundled and its classification identified. It is pointed out that the classification could be done automatically by light sensors which can scan the shakes from across both flat surfaces to detect tone and imperfections in the flat surfaces, as the shakes are conveyed on a conveyor. The shakes can then be automatically classified.

It is within the ambit of the present invention to cover any obvious modifications of the preferred embodiment described herein, provided such modifications fall within the scope of the appended claims.

I claim:

1. A straight-sawn shake for roof and wall cladding of building structures, said shake being produced by sawing individual shake pieces from poor grade logs which will not split uniformly due to imperfections and knots therein, said shake being comprised of a flat wooden individual board piece having opposed flat substantially parallel smooth sawn surfaces free of wood grain roughness and sawn flat parallel straight side edges and straight flat sawn end edges, said board piece being cut from a raw log piece of predetermined length in block form, said board piece being of random width.

2. A wooden shake as claimed in claim 1 wherein said predetermined thickness is approximately, but not exclusively, ⅜ inch.

3. A wooden shake as claimed in claim 1 wherein said raw log piece includes poorer grade logs than that utilized in the manufacture of straight split shakes, there being two or more grades of said straight-sawn shake.

4. A wooden shake as claimed in claim 3 wherein said surface cladding is obtained by overlapping a plurality of said wooden board pieces in straight courses and producing a weather exposed surface portion of said board pieces and with adjacent courses overlapping in flat face-to-face relationship with substantially no undulations along exposed end edges of adjacent overlapped courses.

5. A wooden shake as claimed in claim 4 wherein said overlapping courses of said wooden board pieces have a weather exposure of at least 15% more than conventional wood shingles.

6. A wooden shake as claimed in claim 4 wherein said board pieces each have a length of 16 inches and wherein said weather exposed surfaces of each said courses is from about 5 to 7 inches, depending on said grades.

7. A wooden shake as claimed in claim 4 wherein said board pieces each have a length of 18 inches and wherein said weather exposure of each said courses is from about 5½ to 7½ inches, depending on said grades.

8. A wooden shake as claimed in claim 4 wherein said board pieces each have a length of 24 inches and wherein said weather exposure of each said courses is from about 7½ to 10 inches, depending on said grades.

9. A wooden shake as claimed in claim 1 wherein said log piece is a cedar, fir, pine, spruce or similar wooden piece capable of improved weathering.

10. A wooden shake as claimed in claim 1 wherein said wooden board pieces are treated with a wood preservative to increase the weathering longevity of said board pieces.

11. A wooden shake as claimed in claim 4 wherein at least some of said board pieces contain knots or other wood grain imperfections between said opposed flat sawn surfaces.

12. A wooden shake as claimed in claim 4 wherein said surface coverage is a roof surface, there being a felt sheet laid over a top upper portion of each said courses and laid in such a manner whereby said surface coverage has an intermediate felt surface thereover and entirely under said overlapping courses of said wooden board pieces.

13. A wooden shake as claimed in claim 4 wherein said surface cladding is a sidewall surface, there being no felt sheet utilized over a top upper portion of each said courses.

* * * * *